United States Patent [19]

Prato

[11] Patent Number: 4,510,491

[45] Date of Patent: Apr. 9, 1985

[54] DISPLAY DEVICE FOR PHOTOCOPIERS

[75] Inventor: Francesco Prato, Vialfré , Italy

[73] Assignee: Ing. C. Olivetti & C., S.p.A., Ivrea, Italy

[21] Appl. No.: 341,220

[22] Filed: Jan. 21, 1982

[30] Foreign Application Priority Data

Jan. 22, 1981 [IT] Italy ..... 67070 A/81

[51] Int. Cl.[3] ..... G09G 3/04

[52] U.S. Cl. ..... 340/792; 340/679; 355/14 C

[58] Field of Search ..... 340/521, 674, 679, 691, 340/715, 762, 792; 355/14 C

[56] References Cited

U.S. PATENT DOCUMENTS 4,196,413 4/1980 Sowa ..... 340/792 X
4,343,547 8/1982 Nagashima ..... 340/715 X
4,359,730 11/1982 Kunikane et al. ..... 340/792
4,390,872 6/1983 Murakami et al. ..... 340/679

*Primary Examiner*—David L. Trafton
*Attorney, Agent, or Firm*—W. R. Hulbert

[57] ABSTRACT

A display device 10 consisting of five cells of seven segments each, is used in a photocopying machine in order to indicate normal operation and certain abnormal situations. The latter are indicated by means of messages in plain language, represented by cyclically moving characters. The messages are stored permanently in an EPROM 50, from which they are extracted as required under the command of a CPU 80 in relation to the corresponding type of abnormality, as detected by a set of sensors 82, 84, 86. A suitable subroutine causes the letters of message to slide along the cells of the display device 10 from right to left.

7 Claims, 7 Drawing Figures

DISPLAY DEVICE FOR PHOTOCOPIERS

BACKGROUND OF THE INVENTION

This invention relates to a display device for photocopiers, which can be used for indicating both normal operation and certain abnormal situations.

A device for displaying normal operation and certain irregular operating situations for a copying machine is known, constituted by a set of light sources of LED type, disposed on a board which represents diagrammatically the path of the copy sheet inside the copying machine. As the copy sheet moves along its path from one station to the next, an LED lights up on the machine corresponding to the position occupied by the sheet at that moment. When an abnormal situation occurs, such as jamming of the sheet, or a functional irregularity in some device, a microprocessor is activated by suitable control devices in order to select the corresponding LED on the board and cause it to blink, in order to attract the attention of the operator and to indicate the position in which the abnormal situation has occurred.

This display device has the drawback of occupying considerable space on the machine control panel, and also requires a large number of connection wires (two for each LED), so providing greater risk of faults.

SUMMARY OF THE INVENTION

The object of the present invention is to provide a display device for copying machines which is very compact and reliable, and free from the aforesaid drawbacks.

The display device according to the invention comprises a data display which can be selectively actuated by a control unit of the microprocessor type having at least one non-volatile programmable read-only memory, and sensors for sensing predetermined operating states arranged to activate the microprocessor, wherein the memory is programmed with messages representative of the operating states, and the microprocessor is arranged to display the messages one at a time in response to the sensor output by transferring the successive characters of the messages cyclically from the memory to the display, so that the messages appear to slide along the display.

BRIEF DESCRIPTION OF THE DRAWINGS

The invention will now be described in more detail, by way of example, with reference to the accompanying drawings, in which.

DETAILED DESCRIPTION OF THE PREFERRED EMBODIMENT

Figure 1:
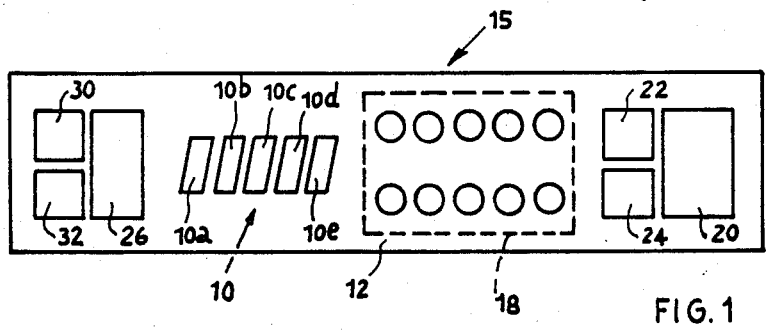
FIG. 1 is a view of a display device embodying the invention, incorporated in the control panel of a photocopier.

With reference to FIG. 1, an alphanumerical display unit 10 is located in a plate 12 which forms the control panel 15 of a photocopying machine. On the plate 12 there is also located an assembly 18 of ten numerical keys for setting the number of copies required, and the following function keys:

- a key 20, PRINT, for starting the copying cycle;
- a key 22, REPEAT, for storing the number of copies required from the various originals;
- a key 24, CLEAR, for cancelling the setting on the keys 18 or for interrupting the run;
- a key 26, COUNT, for displaying in an alternately repetitive manner on the display unit 10 the total number of copies made by the machine, and the number of copies made by the photoconductor drum in use;
- a pair of keys 30, 32 for varying the intensity of exposure in order to obtain darker or lighter copies.

Figure 2:
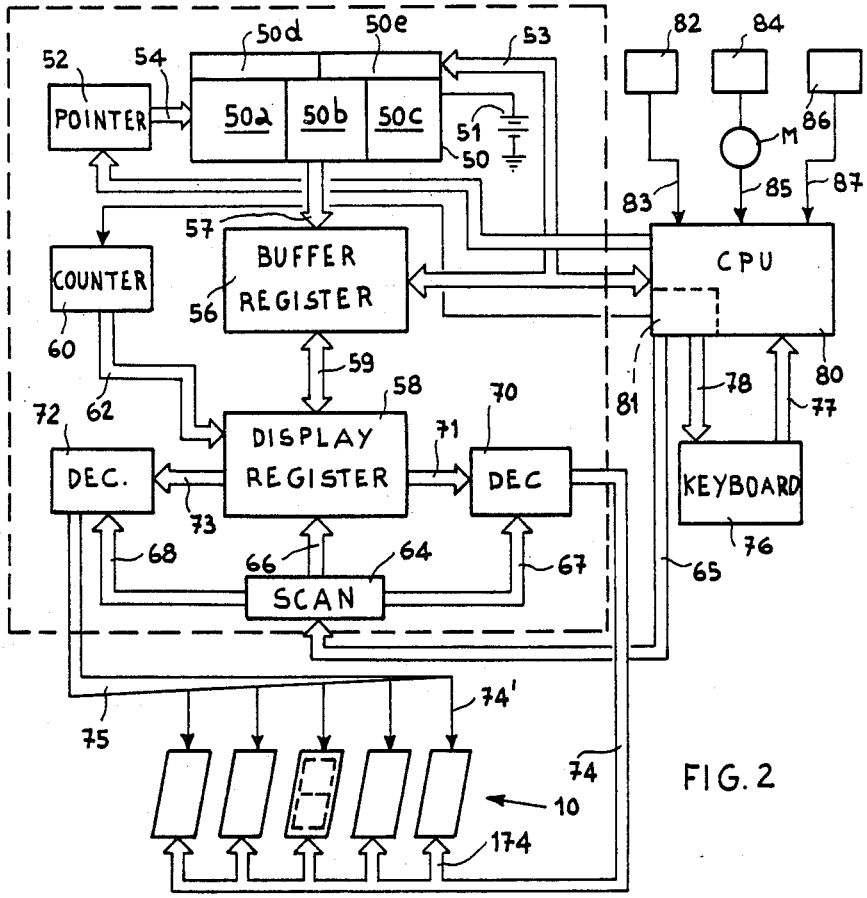
FIG. 2 is a block diagram of the control circuit of the display device of FIG. 1.

The sixteen keys on the control panel 15 are grouped in FIG. 2 into a single block 76, which is connected to a central control unit (CPU) 80 by two channels 77, 78 of four lines each. The control unit 80 cyclically examines each of the keys by the known multiplex method in order to detect which key has been operated at any time.

The display unit 10 is formed from five cells 10*a*, 10*b*, . . . 10*e* of seven LED segments each, of known type. From each cell there emerge eight connection wires, of which seven, grouped into a channel 174 of FIG. 2, are connected to the corresponding seven segments constituting the cell anodes. The eighth wire 74' is connected to the cathode common to the seven anodes.

The display unit 10 can display, in any one of the ways known to the art, numerical indications such as the number of copies set by the keys 18 and indicated by the last two right hand cells 10*d*, 10*e* with the numbers 1 to 99, or the exposure intensity as set by the keys 30, 32 and indicated by the initial left hand cell 10*a* with a number which lies between 1 and 9 and which varies by one unit each time one of the two keys 30, 32 is operated.

The display unit also displays further information, namely a number indicating the total copies made and comprising at the most five digits and a number of four digits indicating the total number of copies deriving from the same photoconductor drum, and preceded by the letter P, both being displayed in alternating repetitive sequence on keeping the key 26 pressed. In addition, certain messages can be displayed to indicate abnormal states of operation of the machine, such as ERROR OPEN, OUT, and PUT COUNTER, which are displayed by the individual letters of each message sliding from right to left repetitively in a rotary sequence. Finally, the display unit 10 also displays certain special symbols to identify certain operation situations, such as a zero displayed in the bottom part of the central cell 10*c* to indicate that the photoconductor drum has attained a predetermined number of copies and must therefore be replaced. A zero displayed in the top part of the central cell 10*c* indicates that the stock of sheets in the feed try is finished.

FIG. 2 shows the block diagram of a circuit by means of which the messages are displayed on the display unit 10. The messages to be displayed are memorised permanently in a non-volatile programmed EPROM read-only memory 50. Each message contains an end-of-message character which enables the CPU 80 to establish when it has to interrupt selection of the characters to be displayed. The preservation of the contents of the memory 50 is ensured by a self-contained power supply for the memory, comprising a long-life battery 51 which allows the contents of the memory to be preserved for at least 1000 hours.

A pointer register 52, containing the addresses of the characters forming the messages to be displayed can gain access to the various locations of the EPROM 50 by means of an address channel 54 for selecting the individual characters of the messages contained therein one at a time in a predetermined order. The EPROM 50 is connected to a 5 bytes buffer register 56 by way of a channel 57 in order to temporarily transfer each character selected by the pointer 52, while the CPU 80 is connected with EPROM 50 and with register 56 by an instruction channel 53. A 5-byte intermediate register 58 known as the display register is connected to the buffer 56 by way of a bidirectional channel 59, and contains at the most five character codes stored in five locations of the register. A counter register 60 is connected to the display register 58 by a channel 62, and contains the addresses of the locations of the display register 58. The counter 60 is able to select the individual locations of the display register 58 in a predetermined sequence as explained hereinafter, in order to transfer the character codes to be displayed from one location to the next. A register 64, known as SCAN, and containing at any time the address of the last character displayed, is connected by a channel 66 to the display register 58 and by the respective channels 67, 68 to two corresponding decoders 70, 72 of known type in order to convert the character code from binary to seven segments. The decoder 70 is connected by a seven line channel 71 to the register 58 and by a seven line channel 74 to the anodes of the five cells of the display unit 10. The decoder 72 is connected by a seven line channel 73 to the register 58 and by a five line channel 75 to the grids of the cells of the display unit 10.

The CPU 80 controls all the copier functions in accordance with a main program which will be partly described, with reference only to the instructions concerning the subject matter of the present invention.

Figure 3:
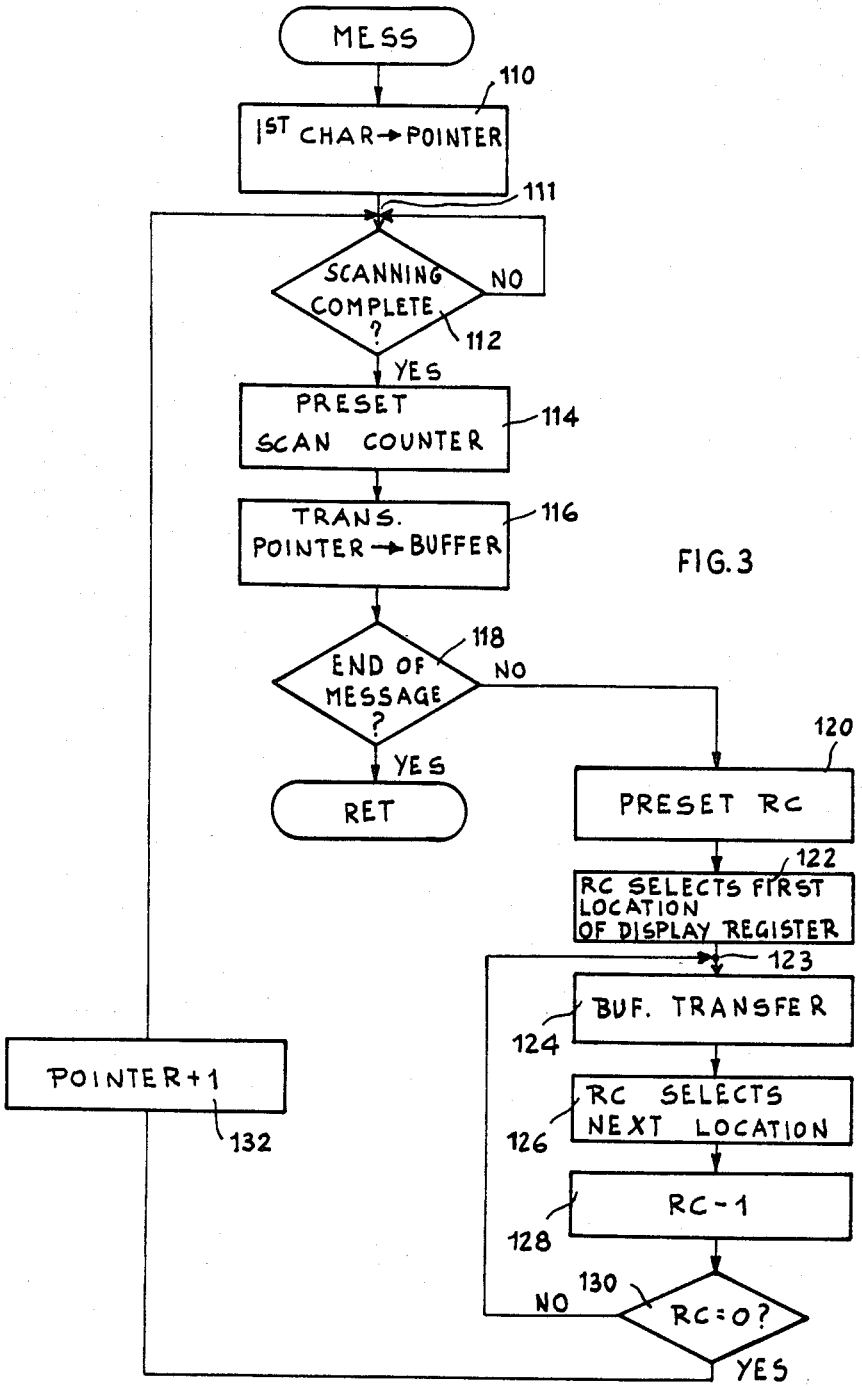
FIG. 3 is a flow diagram of a microprocessor subroutine pertaining to the circuit of FIG. 2.
Figure 4:
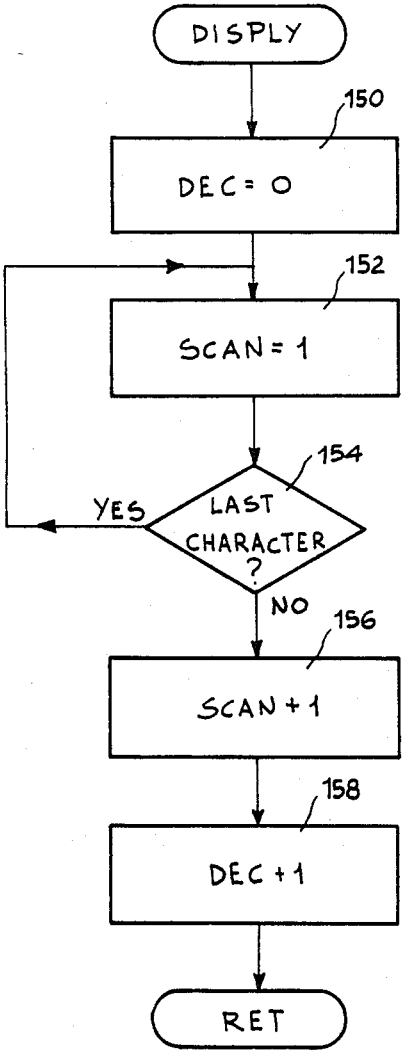
FIG. 4 is a flow diagram of a subroutine for lighting the display device of FIG. 1.
Figure 5:
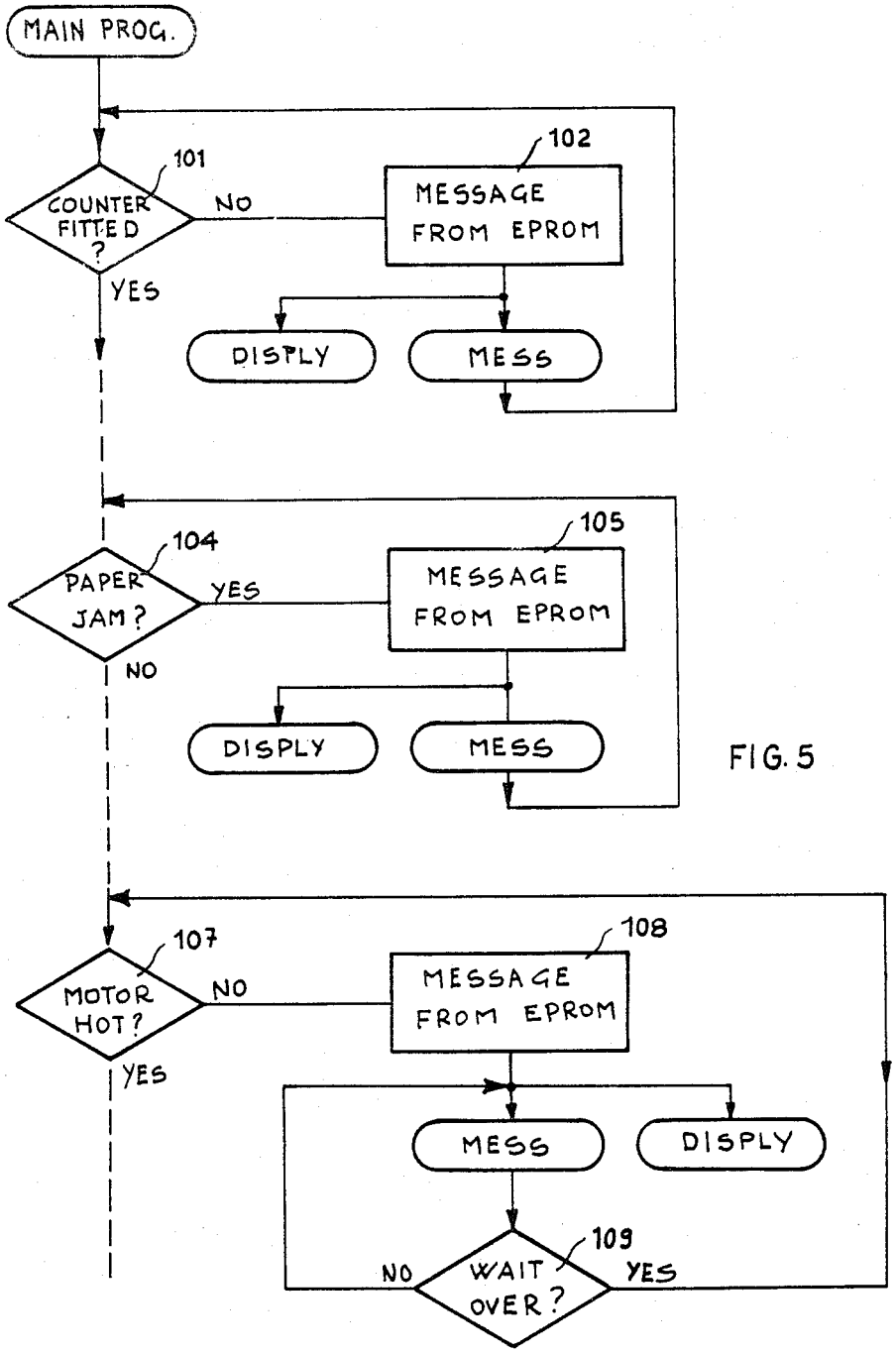
FIG. 5 is a partial flow diagram of the main program for the circuit of FIG. 2.

In addition to the main program shown in FIG. 5, there are subroutines for controlling particular functions and handled by the CPU 80, these comprising in particular the subroutine MESS, shown in FIG. 3, and the subroutine DISPLY, shown in FIG. 4. The subroutine MESS (FIG. 3) controls the display on the display unit 10 of particular messages, as stated heretofore, indicating situations of abnormal copier operation.

In particular, the message "ERROR OPEN" indicates jamming of the copying sheet along its path inside the machine. For this purpose, a sensor 82 (FIG. 2) disposed in the path of the copying sheet in proximity to the machine outlet, feeds a signal through a line 83 to the CPU 80 to indicate that passage of the sheet has taken place. If the sensor 82 feeds no signal within a predetermined time counted in known manner by the CPU 80, the CPU 80 causes the display unit to indicate that jamming of the copying sheet has taken place, as will be described hereinafter. The message "OUT" indicates overheating of the main machine motor, caused by a prolonged, continuous run of the machine. The main machine motor M (FIG. 2) is provided with a thermal sensor 84, which when the motor temperature exceeds a predetermined value interrupts the electrical supply and feeds a signal through a line 85 to the CPU 80, on the basis of which the unit 80 displays the message "OUT" on the display unit 10.

Finally, "PUT COUNTER" tells the operator that it is necessary to connect a copy counter of known type, not described, which is provided for calculating the cost of the copies made. A device 86 for testing the copy counter generates in any known manner a signal through a wire 87 which is at zero logic value when the counter is not connected, so that the CPU 80 indicates this situation.

When a copying cycle is started by pushing the key 20 on the keyboard 15 (FIGS. 1 and 2), the CPU 80 executes a main program represented by a succession of operations in the flow diagram of FIG. 5. When the selection 101 (FIG. 5) is reached, if the result is affirmative, i.e. if the copy counter is connected, the main program continues. If the result is negative, the main program jumps to block 102, by means of which the pointer 52 (FIG. 2) is set for selecting the message "PUT COUNTER" from zone 50*a* of the memory 50. The subroutine MESS (FIG. 3) is then executed, which begins with the block 110 indicating the selection of the first character of the prechosen message by the pointer 52.

A check on the scanning time, block, 112, then follows, during which the characters are displayed as they are selected by the pointer 52. If the scanning time has not yet passed, the subroutine MESS repeatedly returns to point 111 until the scanning time has expired. When the check by the block 112 has a positive result, the program passes to the block 114 which indicates the setting of a scanning counter to a value of 0.2 seconds, this counter being contained in the CPU 80 but not specifically indicated. The block 116 follows, indicating transfer of the character selected by the pointer 52 to the buffer register 56, after which a check is made by block 118 as to whether the character just selected is the end-of-message character. If this check has a positive result, the subroutine is concluded and returns to block 101 of the main program. If however the result of check 118 is negative, the program passes to block 120 which indicates that the counter register 60 is set for selecting the five locations of the display register 58, in that the cells of the display unit 10 are five in number. The next block 122 indicates that the counter register 60 selects the first location of the display register 58. The block 124 indicates that the contents of the buffer register 56 are exchanged with the corresponding location of the display register 58.

In fact when the last character set into the buffer register 56 is transferred in the corresponding location of the display register 58, the characters already located in the display register 58, are temporarily exchanged with corresponding locations of the buffer register 56.

In a next cycle they are again transferred into display register 58, in locations shifted by one position. To this end the block 126 indicates that the counter register 60 selects the next location of the display register 58, while the next block 128 indicates that the counter 60 is decremented by one position. The block 130 follows, by which if the register 60 has already been decremented five times, the routine passes to block 132 in which the pointer 52 is incremented by one unit. If however the register 60 has not yet been decremented five times, the subroutine returns to point 123 between the blocks 122 and 124, in order to complete cycle by cycle the scanning of all five locations of the display register 58. After executing the instructions of block 132, the subroutine MESS returns to point 111, to repeat the operations indicated by blocks 112 and 132 until the entire message selected by the pointer 52 has been scanned.

While the subroutine MESS is being executed, the CPU 80 generates asynchronous interrupts in order to carry out the so-called "refreshing" of the display unit 10, i.e. to display the contents of the display register 58. For this purpose, the CPU 80 activates the SCAN register 64 by way of channel 65 (FIG. 2) at a frequency of 500 Hz, in order to decode the contents of the register 58 by means of the decoders 70, 72, and feed the group of characters present at that time in the register 58 to the display unit 10. The refreshing of the display unit 10 is effected by the procedure of the subroutine DISPLY, indicated in FIG. 4, in which the block 150 indicates the zeroing of the cathodes of the cells 10*a* . . . 10*e*, by means of the decoder 72. This is followed by the block 152 which indicates that the first location of the SCANS register (FIG. 2) is selected by the CPU 80.

A checking block 154 follows, in which a check is made as to whether the address of the selected character is that of the last character of the message. If the result is affirmative, the subroutine returns to point 151 between the blocks 150 and 152, in order to repeat the character selection. If the result is negative, the program passes to the block 156, indicating that the location selected by the SCAN register is incremented by one. The subroutine DISPLY terminates with the block 158, which indicates updating of the decoder 70 (FIG. 2) in order to modify the configuration of the anodes, and the activation of the decoder 72 in order to display the updated configuration on the display unit 10. As the main program (FIG. 5) continues its execution, it reaches the block 104 which checks whether the paper has jammed. If the result is affirmative, the main programme jumps to block 105, by which the pointer 52 is set to select the message "ERROR OPEN" contained in zone 50*b* of the memory 50 (FIG. 2), after which the subroutine MESS (FIG. 3) is started. As already indicated, at each asynchronous interrupt of the subroutine MESS, the subroutine DISPLY is started in order to refresh the display unit.

At the end of each execution cycle of the subroutine MESS, the program returns to the input of block 104 until the cause of the jam is removed, and thus the result of the selection 104 is negative, on which the main program continues normally until it reaches the motor starting block 106. If the motor is overheated, the temperature sensor 84 (FIG. 2) interrupts electrical supply to the motor M and feeds an activation signal through the line 85 to the CPU 80. Simultaneously, the main program examines the selection block 107 (FIG. 5). If the motor is running the result is affirmative and the program proceeds to execute subsequent functions which are not indicated for reasons of brevity. If the result is negative, the main program jumps to block 108 in order to set the pointer 52 for selecting the message "OUT" in zone 50*c* of the memory 50, and to set the counting in known manner for a waiting time of approximately 60 seconds in order to enable the motor to cool down. The subroutines MESS and DISPLY are then started in the manner heretofore described. On conclusion of the subroutine MESS and DISPLY are repeated. If the result is affirmative, the execution returns in the main program to the input block 106. As already stated, other information for which the codes are permanently stored in the sections 50*d* and 50*e* of the memory 50 are displayed on the display unit 10. In section 50*d* for example, the total number of copies made by the copier and the number of copies made by the particular photoconductor drum are stored. These two numbers are processed by a counter 81 normally forming part of the CPU 80, and are fed through a channel 53 to zone 50*d* of the memory 50 (FIG. 2), which zone is of RAM type. On pressing the COUNT key 26 (FIG. 1), a signal is fed to the CPU 80 in order to enable it to display the said two numbers, which are displayed on the display unit alternately while the key 26 is pressed. In section 50*e*, there is permanently stored the code for a symbol, for example the lower-case zero, which can be displayed either by the segments of the bottom part of the cell or by the segments of the top part of the cell, according to the significance which is to be attributed to it. More generally, the section 50*e* can contain alphanumerical symbols composed of more than one character.

Figure 6:
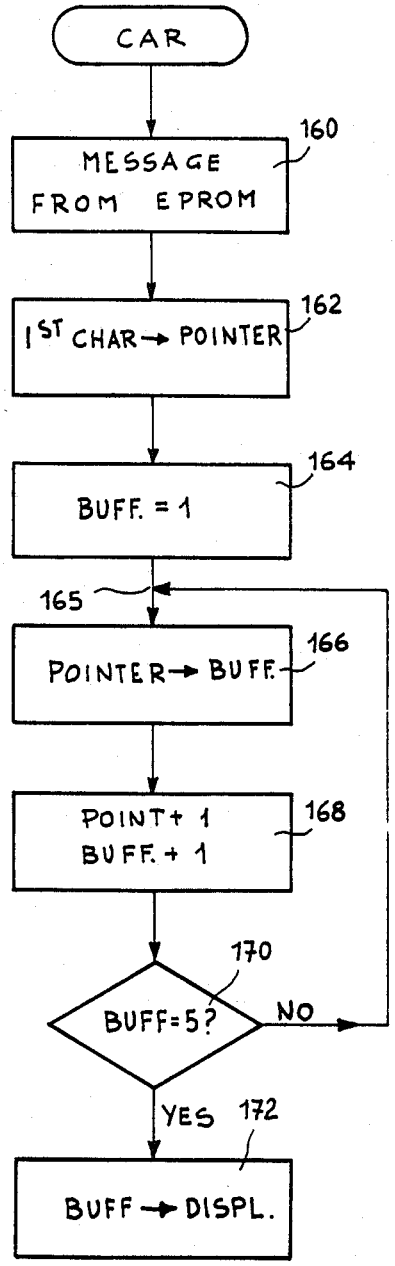
FIG. 6 is a flow diagram of a further subroutine for the circuit of FIG. 2.

A subroutine CAR, shown in FIG. 6, defines the procedure for displaying one or other of these symbols, and commences with a block 160 by which the symbol to be displayed is selected by the pointer 52 under the control of the control unit 80. This is followed by the block 162 indicating that the pointer 52 selects the first character of the preselected symbol. The next block 164 indicates the selection of the first location of the buffer register 56 (FIG. 2) into which the character selected by the pointer 52 is transferred at block 166. Block 168 gives the instruction for incrementing the pointer 52 and register 56 by one unit. The checking block 170 follows, in which a check is made as to whether the $n^{th}$ location of the buffer 56 has already been selected, where n, which is greater than or equal to 1 (and assumed to be 5 in block 170 as illustrated) is the number of component characters of the symbol to be displayed. If the result is negative, the program returns to point 165 between the blocks 164 and 166. If the result is affirmative, the program terminates with the block 172 indicating the transfer of the contents of the buffer register 56 into the display register 58 (FIG. 2). The control unit 80 then starts the subroutine DISPLY, described heretofore, for displaying the selected message.

Figure 7:
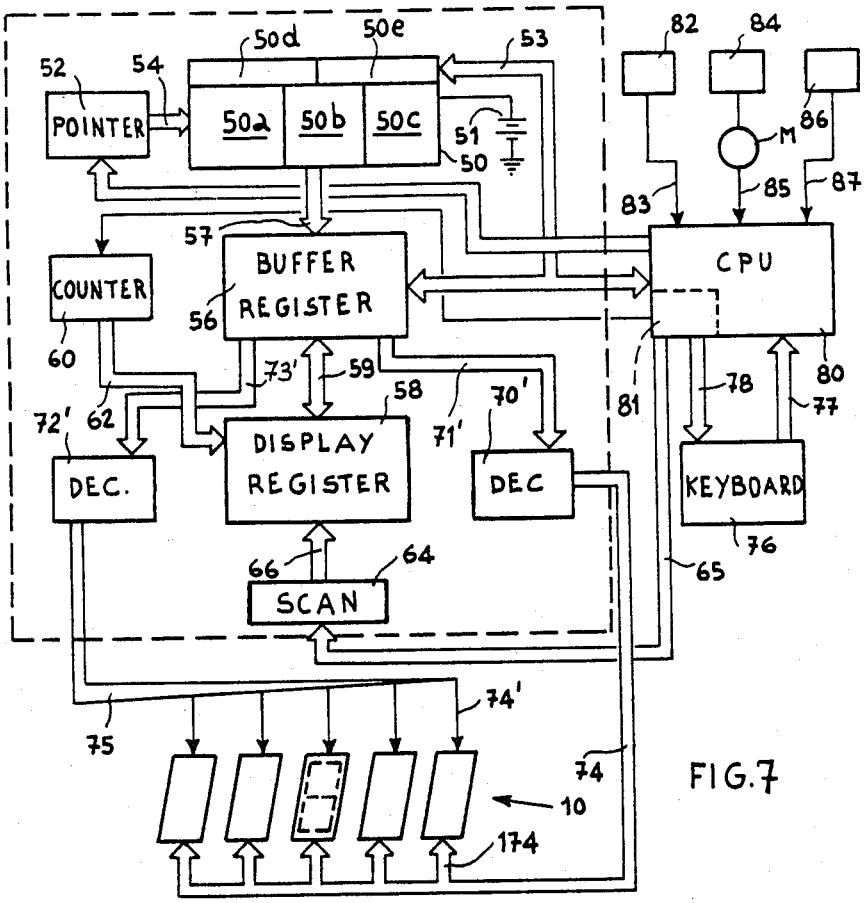
FIG. 7 shows a second embodiment of the circuit of FIG. 2.

According to a second embodiment of the invention, the display register 58 (FIG. 2) contains the characters to be displayed ordered according to seven segment code. In the block circuit of FIG. 7, showing the circuit of this second embodiment, the decoders 70 and 72 of FIG. 2 are replaced by two corresponding output gates 70', 72' of a known type. The buffer register 56 is now connected through channels 71', 73' to the output gates 70', 72', which in turn are connected through the channels 74, 75 respectively to the anodes and to the control electrodes or grids of the five cells 10*a* . . . 10*e*. The output gates 70', 72' reset the anodes and the control electrodes of the cells 10*a* . . . 10*e*, according to corresponding instructions sent by the control unit 80 through channels 53, 71', 73', and operates as an impedence adapter between the buffer register 56 and the display 10.

Whenever the SCAN register is incremented by the control unit 80 with the address of a new character to be displayed, the code of said character contained into the register 58 is transferred to the buffer register 56 and then, through the channels 71', 73', to the display 10, without any further decoding.

The subroutine DISPLY of FIG. 4 is slightly modified as follows: after a check is made in the block 154, if the result is affirmative, i.e. if the selected digit address is related to the last character of the message, the subroutine passes to the block 156, indicating that the SCAN register is set with the address of the first digit to be displayed. If the result is negative, the subroutine jumps directly to the block 158 which indicates updating of the gate 70', in order to modify the configuration of the anodes and the activation of the gate 72' in order to display the updated configuration on the display 10.

I claim:

1. A display device for displaying control messages on a photocopier, comprising a microprocessor unit (80) arranged to handle program instructions and including a read only memory (50) permanently loaded with the character codes of said control messages, a multicell display unit, selectively actuated by said microprocessor to cyclically display said messages, a display register connected to said display unit to contain said characters to be displayed, sensing means responsive to predetermined operating conditions of said photocopier for supplying the microprocessor with activations signals, means cyclically shifting the actuation of the cells of said multicell display unit, each cell being of the seven segment type and adapted to be directly actuated by said character codes, and a pointer register (52) being activated by said microprocessor at the occurrence of said signals to select successively and cyclically from said read only memory (50) each character code of the message to be displayed at a predetermined rate, the microprocessor being so programmed as (a) firstly to transfer one selected character code at a time to a buffer register (56) connected between said memory and said display register, (b) to transfer character code from said buffer register to a corresponding location of the display register and then exchange temporarily the contents of all the locations of said display register back to said buffer register, and again (c) to transfer the contents of the buffer register to the display register in locations shifted by one position whereby all character codes of the message to be displayed are shifted successively and cyclically across the locations of the display register.

2. A display device as claimed in claim 1, wherein said microprocessor generates asynchronous interrupts for activating a scan register to feed at a rate different from said predetermined rate the contents of said buffer register to said display unit, whereby said message appears to move along said display unit.

3. A display device as claimed in claim 1, wherein each of said buffer register and of said display register comprises a number of locations equal to the number of cells of said display unit.

4. A display device as claimed in claim 2, wherein each of said buffer register and of said display register comprises a number of locations equal to the number of cells of said display unit.

5. A display device as claimed in claim 3, wherein the contents of the buffer register (52) after the exchange with the contents of the display register (58) is retained there for a predetermined time, corresponding to said predetermined rate.

6. A display device as claimed in claim 4, wherein the contents of the buffer register (52) after the exchange with the contents of the display register (58) is retained there for a predetermined time, corresponding to said predetermined rate.

7. A display device as claimed in claim 5 or claim 6, wherein the message character codes contained in the buffer register (56) are repeatedly displayed at a frequency with a period less than said predetermined rate, to allow an easy readable image on said display unit.

* * * * *